US006478509B2

(12) United States Patent
Powley

(10) Patent No.: US 6,478,509 B2
(45) Date of Patent: Nov. 12, 2002

(54) HARNESS WEIGHT TRANSFER SYSTEM FOR SCUBA DIVING

(76) Inventor: Robert L. Powley, 314 Washington St. #3, Hoboken, NJ (US) 07030

( * ) Notice: Subject to any disclaimer, the term of this patent is extended or adjusted under 35 U.S.C. 154(b) by 0 days.

(21) Appl. No.: 09/323,786

(22) Filed: Jun. 1, 1999

(65) Prior Publication Data

US 2001/0018008 A1 Aug. 30, 2001

(51) Int. Cl.[7] ..... B63C 11/02

(52) U.S. Cl. ..... 405/186; 224/255; 224/259; 224/904; 224/934

(58) Field of Search ..... 405/185, 186; 224/181, 195, 255, 259, 268, 269, 664, 904, 934

(56) References Cited

U.S. PATENT DOCUMENTS

| | | | | | |
|---|---|---|---|---|---|
| 2,982,105 | A | | 5/1961 | Akers | 61/70 |
| 3,039,273 | A | * | 6/1962 | Swindell | 405/186 |
| 3,090,205 | A | | 5/1963 | Hurwitz et al. | 61/70 |
| 3,105,359 | A | | 10/1963 | Ellis | 61/70 |
| 3,135,098 | A | | 6/1964 | Root | 61/70 |
| 3,263,432 | A | | 8/1966 | Maskell | 61/70 |
| 3,808,824 | A | * | 5/1974 | Johnston et al. | 405/186 |
| 3,851,488 | A | * | 12/1974 | Schuler | 405/186 |
| 4,440,525 | A | * | 4/1984 | Perla | 405/186 |
| 4,467,946 | A | * | 8/1984 | Brown | 224/904 |
| 4,623,316 | A | * | 11/1986 | Ratiff | 441/106 |
| 4,732,305 | A | * | 3/1988 | Courtney et al. | 405/186 |
| 4,762,257 | A | * | 8/1988 | Spillers et al. | 224/904 |
| 4,789,270 | A | * | 12/1988 | Selisky | 405/186 |
| 4,887,932 | A | | 12/1989 | Toth | 405/186 |
| 5,085,163 | A | | 2/1992 | VanTassel et al. | 114/315 |
| 5,183,326 | A | * | 2/1993 | Case | 224/181 |
| 5,201,448 | A | * | 4/1993 | Schue | 224/904 |
| 5,205,672 | A | * | 4/1993 | Stinton | 405/186 |
| 5,311,833 | A | * | 5/1994 | VanTassel et al. | 405/186 |
| 5,328,298 | A | * | 7/1994 | Maffatone | 405/185 |
| 5,516,233 | A | * | 5/1996 | Courtney | 405/186 |
| 5,588,940 | A | * | 12/1996 | Price et al. | 224/259 |
| 5,607,258 | A | * | 3/1997 | Eungard | 405/186 |
| 5,803,667 | A | * | 9/1998 | Seligman | 405/186 |
| 5,855,454 | A | * | 1/1999 | Courtney et al. | 405/186 |
| 5,860,769 | A | * | 1/1999 | Seligman | 405/186 |
| 5,913,640 | A | * | 6/1999 | Bortner | 405/186 |
| 5,944,450 | A | * | 8/1999 | Anderson | 405/186 |
| 6,030,147 | A | * | 2/2000 | Bowden | 405/186 |
| 6,108,816 | A | * | 8/2000 | Bradley | 2/102 |
| 6,132,142 | A | * | 10/2000 | Carmichael | 405/186 |
| 6,146,053 | A | * | 11/2000 | Nelson | 405/186 |
| 2001/0016149 | A1 | * | 8/2001 | Garofalo | 405/186 |

FOREIGN PATENT DOCUMENTS

| | | | | |
|---|---|---|---|---|
| EP | 0826594 A2 | * | 8/1997 | B63C/11/30 |
| FR | 2590540 | * | 11/1985 | B63C/11/30 |
| GB | 1587124 | | 4/1981 | |

OTHER PUBLICATIONS

Ocean Management Systems, Inc. 1999 Catalog, Cover Page, pp. 12 and 13, published prior to Jun. 1, 1999.

* cited by examiner

*Primary Examiner*—Thomas B. Will
*Assistant Examiner*—Alexandra K. Pechhold

(57) ABSTRACT

A weight system for a scuba diver that has a pocket for housing a weight with an opening on the bottom and a releasable flap for covering the opening. When the releasable flap is in a closed position. the opening is covered to keep a weight in the pocket, and when the releasable flap is in a released position, the opening is uncovered to allow the weight to fall out of the pocket due to gravity. The apparatus also includes a way for opening one end of the releasable flap and attachment devicesto secure the pocket to an underwater diving harness.

3 Claims, 2 Drawing Sheets

HARNESS WEIGHT TRANSFER SYSTEM FOR SCUBA DIVING

TECHNICAL FIELD

This invention relates to the field of scuba diving and the current methods and apparatus used by divers to carry weight in order to become negatively buoyant in water.

BACKGROUND

In the field of scuba diving, divers customarily wear a Harness System with a Back Plate as a means to hold the tanks to the body with a buoyancy compensating device mounted between the back plate and tanks. These harness systems typically employ shoulder straps, a waist strap, a chest strap and a crotch strap. A Harness system is a preferred method of holding tanks and buoyancy compensating devices because it does not restrict the diver and places the buoyancy compensating device and tanks behind the back and away from the diver. However, current methods for carrying weight on the diver are not designed to be worn with a harness. The present methods for carrying weight include: weight belts worn around the divers waist, which interferes with the waist strap of the harness system making them uncomfortable and dangerous since the harness system and weight belt can be entangled during any emergency release; pockets or weights that can be worn directly on the existing waist strap of the harness system, which are dangerous because they often can not be immediately released and they pull the waist strap down negatively effecting the fit of the harness; and weight systems that are basically weight belts attached to a set of suspenders which add extra bulk under a harness system restricting movement, are expensive to manufacture and still present entanglement concerns when worn under the harness system.

The present invention is superior to the prior art because it provides a simple, controlled and inexpensive means for a diver using a harness system to carry his weight without interfering with the harness system. The existing system mounts a pair or single weight pocket by a movable or fixed means to the existing waist strap of the harness system. Therefore, it eliminates the need for extra weight belts and weight harness/ suspender systems reducing the bulk under a Harness System allowing the diver continued unrestricted movement and providing a means to keep the weight close to the diver's body by preventing the weight pocket(s) from swing out from the diver's body. Additionally, an emergency release means can be added to the weight pocket(s) to allow a quick release of the weight from the weight pocket(s). By allowing for the release of the weight directly from the weight pocket(s) attached to the harness system, the weights can be quickly released in an emergency without the danger of further entanglement with the Harness System and any time a diver is transporting the harness system out of the water. Finally, this system can further comprise a suspension means mounted in a fixed or pivoting means to the weight pocket(s) and attached in a fixed or pivoting means to the shoulder strap of the harness system on the respective side or sides the diver places the weight pocket(s). This adds many benefits over the prior art to the current system, including: the weight does not pull the waist strap of the harness system down; the weight is supported by the shoulder strap(s) preventing the pocket(s) from moving down the diver's waist; and the weight is shifted form the diver's waist to the shoulder strap(s) increasing balance, comfort and acting as a counter weight to the weight of the tanks on the diver's back facilitating transporting on land and ease of movement in the water.

In addition to holding traditional weight, the weight pockets can be used to hold other supplies that are used by the diver. Further, an outside pocket can be attached to the front of the weight pocket to provide two compartments for storage, such as negative weight in the rear pocket and divers supplies in the front pocket. The front pocket does not need an emergency release if used only to store supplies and other equipment, but an emergency release can also be employed, as used on the weight pocket, to provide a quick release mechanism to empty the contents of the pocket.

SUMMARY OF THE INVENTION

It is an object or the present invention to provide a harness weight system that can easily and safely attached to a divers harness system to provide negative weight and/or storage.

BRIEF DESCRIPTION OF THE DRAWINGS

Referring to FIG. 1, a weight pocket 6 has a flap 4 held closed by Velcro or other releasable fastening means. A handle 5 is mounted to the flap 4 to allow the weight pocket to be pulled open and release the contents of weight pocket 6, A closure means 3, such as a zipper, is attached to the top of the weight pocket 6 to allow access. A suspension means 2, such as nylon webbing, is mounted to the weight pocket 6 and includes an adjustable or fixed shoulder attachment means 1, which could be a plastic or metal fastener or ladder lock to loop the nylon through.

Referring to FIG. 2, attachment means 7, such as one or more loops of nylon webbing, for attaching the pocket to a waist strap of a harness, is attached to the back of weight pocket 6. A suspension means 2, such as nylon webbing, is fixed or movably mounted by attachment means 8, which could comprise a "d" shaped ring that would allow the suspension means to pivot, to the weight pocket 6 and includes an adjustable or fixed shoulder attachment means 1, which could be a plastic or metal fastener or ladder lock to loop the nylon webbing through.

Referring to FIG. 3, a back plate 18 is attached to two shoulder straps 9. Shoulder straps 9 is attached to two rings 19. Rings 19 are attached to a chest strap 10 which includes a chest fastener 13. Rings 19 are attached to two side straps 20. A waist strap 11 is attached to back plate 18 and includes a waist fastener 14. A crotch strap 12 is attached to the bottom of back plate 18 and waist strap 11 and includes crotch fastener 15.

Referring to FIG. 4, weight pockets 6 are attached to waist strap 11 via attachment means 7. The suspension means 2 is fixed or movably mounted by shoulder attachment means 1 to rings 19.

Referring to FIG. 5, a second pocket 17 is attached on the sides and top of the front of weight pocket 6 allowing flap 4 to open from the bottom by pulling handle 5. The second pocket 17 has a second closure means 16, such as a zipper, to allow access to the second pocket 17.

Figure 1:
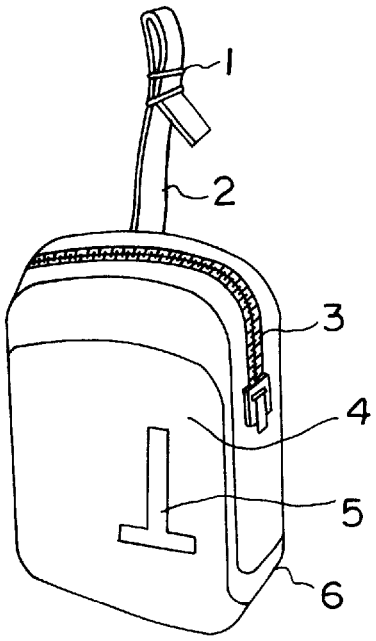
FIG. 1 illustrates a front view of the harness weight transfer system.
Figure 2:
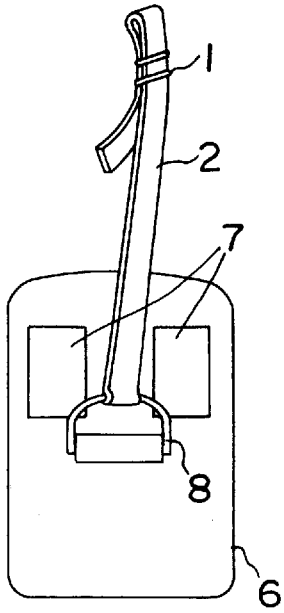
FIG. 2 illustrates a back view of the harness weight transfer system.
Figure 5:
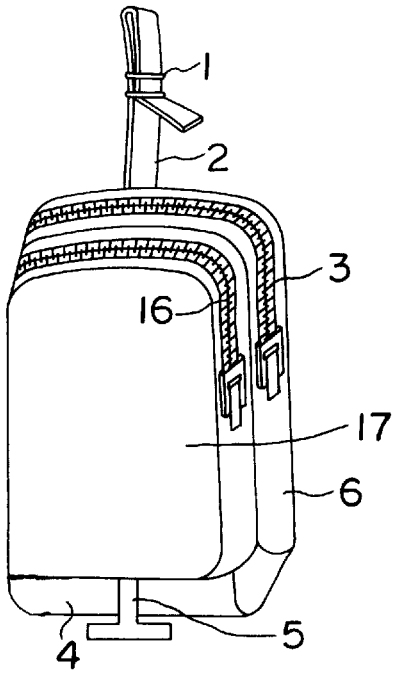
FIG. 5 illustrates a front view of an alternative embodiment.
Figure 3:
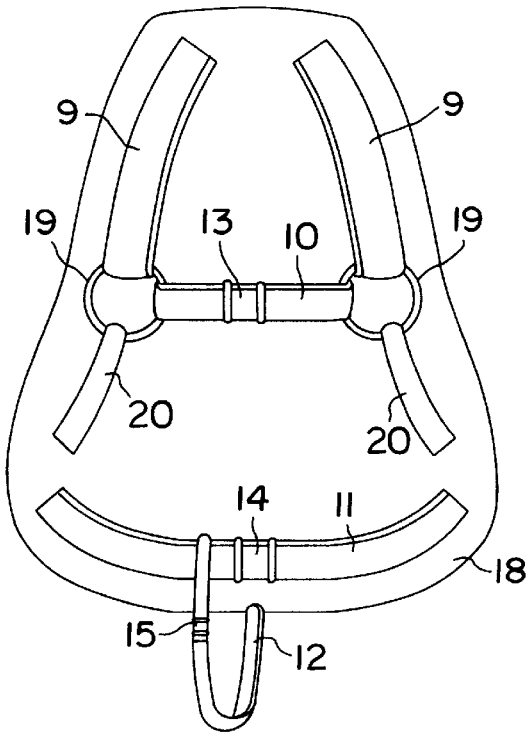
FIG. 3 illustrates a diving harness.
Figure 4:
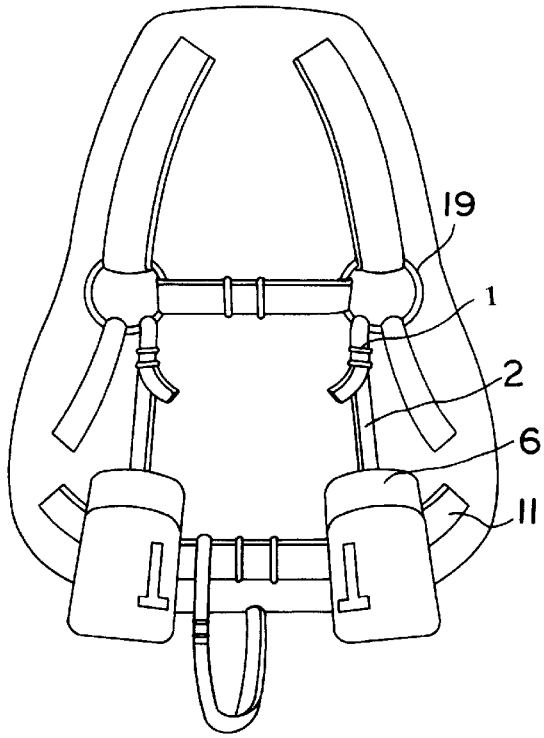
FIG. 4 illustrates a diving harness in combination with the invention.

I claim:

1. An apparatus comprising:

a pocket for housing a weight, said pocket comprising a first opening positioned at the bottom of said pocket and a releasable flap for covering said first opening, wherein when said releasable flap is in a closed position, said first opening is covered to keep a housed weight in said pocket, and when said releasable flap is in a released position, said first opening is uncovered to allow the housed weight to fall out of said pocket through said first opening due to gravity, means for releasable fastening one end of said releasable flap to a first side of said pocket, and an attachment member affixed to a second side of said pocket; and means for suspending said pocket from an underwater diving harness, said suspension means comprising a first end and a second end, wherein said first end of said suspension means is attached to said attachment member of said pocket, and said second end of said suspension means comprises shoulder attachment means for attaching said second end to the underwater diving harness.

2. An apparatus according to claim 1, wherein said shoulder attachment means permits said suspension means to attach to a shoulder strap ring of the underwater diving harness.

3. An apparatus according to claim 1, wherein said shoulder attachment means comprises a fastener or a ladder lock.

* * * * *